US011754276B2

(12) United States Patent
Spruiel

(10) Patent No.: US 11,754,276 B2
(45) Date of Patent: Sep. 12, 2023

(54) CROSS-SHAPED ILLUMINATING DEVICE

(71) Applicant: Anthony Spruiel, Hampton, VA (US)

(72) Inventor: Anthony Spruiel, Hampton, VA (US)

( * ) Notice: Subject to any disclaimer, the term of this patent is extended or adjusted under 35 U.S.C. 154(b) by 0 days.

(21) Appl. No.: 17/574,359

(22) Filed: Jan. 12, 2022

(65) Prior Publication Data

US 2023/0220987 A1 Jul. 13, 2023

(51) Int. Cl.

| | |
|---|---|
| ***F21V 33/00*** | (2006.01) |
| ***A47G 33/02*** | (2006.01) |
| ***F21W 121/00*** | (2006.01) |
| ***F21V 15/015*** | (2006.01) |

(52) U.S. Cl.

CPC ..... *F21V 33/0028* (2013.01); *A47G 33/02* (2013.01); *F21V 15/015* (2013.01); *F21W 2121/00* (2013.01)

(58) Field of Classification Search

CPC .... A47G 33/02; F21Y 2115/10; F21V 7/0066
See application file for complete search history.

(56) References Cited

U.S. PATENT DOCUMENTS

| | | | | | |
|---|---|---|---|---|---|
| 1,507,195 | A * | 9/1924 | Moore | G09F 13/00 | 428/3 |
| 1,980,708 | A * | 11/1934 | Sxel | H01R 33/00 | 428/3 |
| 5,255,170 | A * | 10/1993 | Plamp | A47G 33/02 | 428/3 |
| 2005/0201109 | A1* | 9/2005 | Shimura | F21V 5/045 | 362/382 |
| 2008/0172918 | A1* | 7/2008 | Weiss | A47G 33/08 | 40/611.01 |
| 2010/0085743 | A1* | 4/2010 | Franklin | F21S 9/037 | 362/183 |
| 2012/0262910 | A1* | 10/2012 | Ledesma | A47G 33/02 | 362/121 |
| 2016/0324355 | A1* | 11/2016 | Garcia | A47G 33/02 | |
| 2017/0273418 | A1* | 9/2017 | Chatman | A45C 13/001 | |

* cited by examiner

*Primary Examiner* — Alexander K Garlen
(74) *Attorney, Agent, or Firm* — The Iwashko Law Firm, PLLC; Lev Ivan Gabriel Iwashko

(57) ABSTRACT

A cross-shaped illuminating device, including a main body, and an illuminating unit, including a cross body having a cross shape disposed on at least a portion of the main body, a plurality of lights disposed on at least a portion of the cross body to illuminate a surrounding area, and a plurality of light covers disposed on at least a portion of the cross body to cover each of the plurality of lights.

7 Claims, 1 Drawing Sheet

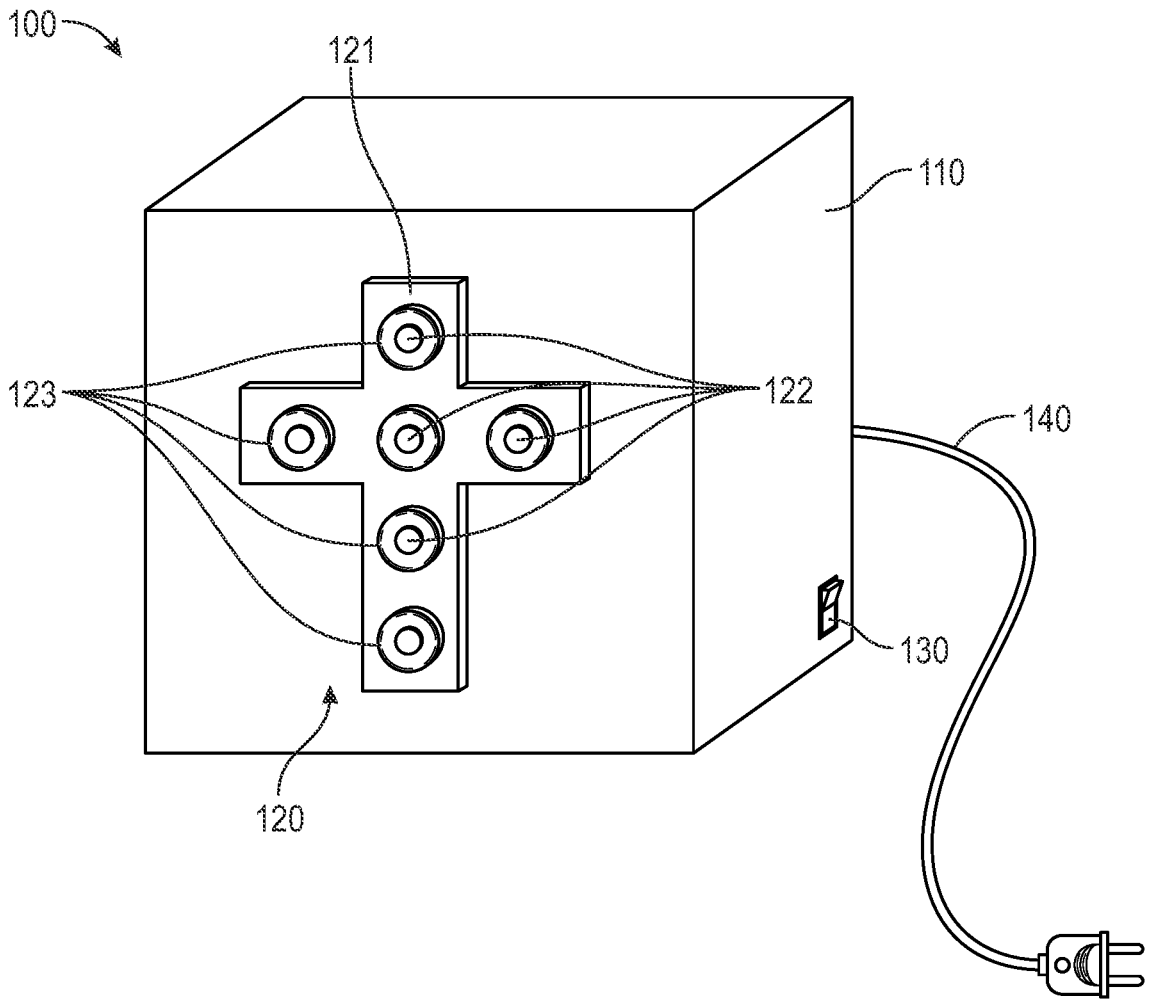
100
121
110
123
122
140
130
120

CROSS-SHAPED ILLUMINATING DEVICE

BACKGROUND

1. Field

The present general inventive concept relates generally to lights, and particularly, to a cross-shaped illuminating device.

2. Description of the Related Art

Lighting accessories are commonly used for a variety of reasons such as a source of illumination and create a unique aesthetic. Moreover, for common lighting accessories, the manner of illumination is emphasized as opposed to the effect created after the light is emitted. In other words, the common lighting accessory will illuminate an area, but create no other meaning for a user.

The common lighting accessory lacks any appeal and/or application for a religious service. Thus, the common lighting accessory could not be used for the religious service as a symbol of faith (e.g., a cross).

Therefore, there is a need for cross-shaped illuminating device to illuminate the area that appears as the symbol of faith.

SUMMARY

The present general inventive concept provides a cross-shaped illuminating device.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a cross-shaped illuminating device, including a main body, and an illuminating unit, including a cross body having a cross shape disposed on at least a portion of the main body, a plurality of lights disposed on at least a portion of the cross body to illuminate a surrounding area, and a plurality of light covers disposed on at least a portion of the cross body to cover each of the plurality of lights.

The cross body may protrude away from the main body.

Each of the plurality of lights may be distanced with respect to each other.

Each of the plurality of lights may be enclosed between the cross body and at least one of the plurality of light covers.

Each of the plurality of light covers may be dome-shaped.

Each of the plurality of light covers may be constructed as a one-way mirror.

BRIEF DESCRIPTION OF THE DRAWINGS

These and/or other features and utilities of the present generally inventive concept will become apparent and more readily appreciated from the following description of the embodiments, taken in conjunction with the accompanying drawings of which:

FIG. 1 illustrates an isometric top view of a cross-shaped illuminating device, according to an exemplary embodiment of the present general inventive concept.

DETAILED DESCRIPTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Cross-Shaped Illuminating Device 100
Main Body 110
Illuminating Unit 120
Cross Body 121
Lights 122
Light Covers 123
Switch 130
Power Source 140

FIG. 1 illustrates an isometric top view of a cross-shaped illuminating device 100, according to an exemplary embodiment of the present general inventive concept.

The cross-shaped illuminating device 100 may be constructed from at least one of metal, plastic, wood, glass, and rubber, etc., but is not limited thereto.

The cross-shaped illuminating device 100 may include a main body 110, an illuminating unit 120, a switch 130, and a power source 140, but is not limited thereto.

Referring to FIG. 1, the main body 110 is illustrated to have a rectangular prism shape. However, the main body 110 may be rectangular, circular, cylindrical, triangular, pentagonal, hexagonal, heptagonal, octagonal, or any other shape known to one of ordinary skill in the art, but is not limited thereto.

The main body 110 may be removably disposed on at least a portion of a surface, such as a ground surface, a wall, a table, a countertop, etc. For example, a base of the main body 110 may be disposed on the surface, using at least one fastener (e.g., a screw, a nail, a bolt, a washer, a nut, an adhesive (e.g., tape, glue), etc.) and/or without the at least one fastener. Also, the main body 110 may have a predetermined size (e.g., length, width height), such as 3.5 inches in length, 2.5 inches in width, and 3.g inches in height, but the predetermined size of the main body 110 may be based on a preference of a user and/or a manufacturer.

The illuminating unit 120 may include a cross body 121, a plurality of lights 122, and a plurality of light covers 123, but is not limited thereto.

The cross body 121 may be disposed on at least a portion of the main body 110. The cross body 121 may have a shape of a cross. Also, referring again to FIG. 1, the cross body 121 may protrude away from the main body 110. Moreover, a first portion of the cross body 121 may extend from a first side of the main body 110 toward a second side of the main body 110 opposite with respect to the first side. Additionally, a second portion of the cross body 121 may extend from a third side of the main body 110 toward a fourth side of the main body 110 opposite with respect to the third side. The second portion of the cross body 121 may be perpendicularly disposed away from the first portion of the cross body 121 in a first direction and a second direction opposite with respect to the first direction. In other words, the cross body 121 may be cross-shaped.

Each of the plurality of lights 122 may include an incandescent light bulb, a light-emitting diode (LED), a halogen light, a fluorescent light, and a neon light, but is not limited thereto.

The plurality of lights 122 may be disposed on at least a portion of the cross body 121. Each of the plurality of lights 122 may be linearly arranged on the cross body 121. Accordingly, the plurality of lights 122 may appear as a cross shape. Moreover, each of the plurality of lights 122 may be distanced with respect to each other. Each of the plurality of lights 122 may illuminate a surrounding area of each of the plurality of lights 122, the cross body 121, and/or the main body 110.

Each of the plurality of light covers 123 may include a dome-shaped (e.g., semi-spherical) cover, but is not limited thereto.

Each of the plurality of light covers 123 may cover at least one of the plurality of lights 122. In other words, each of the plurality of lights 122 may be enclosed between the cross body 121 and/or at least one of the plurality of light covers 123. Each of the of the plurality of light covers 123 may be perpendicularly disposed away from the cross body 121 with respect to a direction. Also, each of the plurality of light covers 123 may be convex over at least one of the plurality of lights 122.

Furthermore, each of the plurality of light covers 123 may be constructed as a one-way mirror. More specifically, each of the plurality of light covers 123 may be transparent on an interior surface thereof. Each of the plurality of light covers 123 may facilitate movement of a beam of light from at least one of the plurality of lights 122 to an exterior environment around the plurality of light covers 123. In other words, the interior surface of each of the plurality of light covers 123 may only allow light to move through interior surface, such that a beam of light from the plurality of lights 122 moves through the interior surface of the plurality of light covers 123. However, an exterior surface of each of the plurality of light covers 123 may prevent the any beam of light from entering into the plurality of light covers 123, such that each of the plurality of light covers may reflect the light away from the exterior surface thereof. As such, each of the plurality of light covers 123 may be considered a one-way mirror.

Alternatively, each of the plurality of light covers 123 may be fully transparent.

It is important to note that a number of the plurality of light covers 123 may correspond to a number of the plurality of lights 122.

The switch 130 may be disposed on at least a portion of the main body 110. The switch 130 may turn on the plurality of lights 122 in response to moving from off in a first position to on in a second position. Conversely, the switch 130 may turn off the plurality of lights 122 in response to moving from on in the second position to off in the first position. Also, the switch 130 may switch modes of the plurality of lights 122 based on how long the switch 130 is held. For example, the switch 130 may flash, strobe, change speed, change color in response to depressing the switch 130 for a predetermined period of time (e.g., five seconds, ten seconds, fifteen seconds, etc.).

Referring again to FIG. 1, the power source 140 is illustrated to be a power cord. However, the power source 140 may include a battery and a solar cell, but is not limited thereto.

The power source 140 may be disposed on and/or within at least a portion of the main body 110. The power source 140 may provide power to the illumination unit 120 and/or the switch 130.

The cross-shaped illuminating device 100 may illuminate the surrounding area and provide a strong reminder of a symbol of faith for the user. Also, the cross-shaped illuminating device 100 may be used in a variety of environments, including both indoors and outdoors.

The present general inventive concept may include a cross-shaped illuminating device 100, including a main body 110, and an illuminating unit 120, including a cross body 121 having a cross shape disposed on at least a portion of the main body 110, a plurality of lights 122 disposed on at least a portion of the cross body 121 to illuminate a surrounding area, and a plurality of light covers 123 disposed on at least a portion of the cross body 121 to cover each of the plurality of lights 122.

The cross body 121 may protrude away from the main body 110.

Each of the plurality of lights 122 may be distanced with respect to each other.

Each of the plurality of lights 122 may be enclosed between the cross body 121 and at least one of the plurality of light covers 123.

Each of the plurality of light covers 123 may be dome-shaped.

Each of the plurality of light covers 123 may be constructed as a one-way mirror.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A cross-shaped illuminating device, comprising:

a main body; and an illuminating unit, comprising:

a cross shape disposed entirely on a side of the main body on an outer surface of the main body, such that the cross body has a different shape than the main body, such that a first portion of the cross body is perpendicularly disposed with respect to a second portion of the cross body, such that the first portion of the cross body and the second portion of the cross body are both disposed against the first side of the main body, a plurality of lights disposed on at least a portion of the cross body to illuminate a surrounding area, and a plurality of light covers disposed on at least a portion of the cross body to cover each of the plurality of lights, wherein at least one of a switch and a power source are disposed on a second side of the main body and electrically connected to the plurality of lights.

2. The cross-shaped illuminating device of claim 1, wherein the cross body protrudes away from the main body.

3. The cross-shaped illuminating device of claim 1, wherein each of the plurality of lights are distanced with respect to each other.

4. The cross-shaped illuminating device of claim 1, wherein each of the plurality of lights are enclosed between the cross body and at least one of the plurality of light covers.

5. The cross-shaped illuminating device of claim 1, wherein each of the plurality of light covers are dome-shaped.

6. The cross-shaped illuminating device of claim 1, wherein each of the plurality of light covers are constructed as a one-way mirror.

7. A cross-shaped illuminating device, comprising:

a main body; and an illuminating unit, comprising:

a cross shape disposed entirely on a side of the main body, such that the side of the main body is on a first plane, such that the cross body is disposed on a second plane in parallel to the first plane, a plurality of lights disposed on at least a portion of the cross body to illuminate a surrounding area, and a plurality of light covers disposed on at least a portion of the cross body to cover an entirety of a surface area of each of the plurality of lights, wherein at least one of a switch and a power source are disposed on a second side of the main body and electrically connected to the plurality of lights.

* * * * *